US008639499B2

(12) United States Patent
Kale et al.

(10) Patent No.: US 8,639,499 B2
(45) Date of Patent: Jan. 28, 2014

(54) FORMANT AIDED NOISE CANCELLATION USING MULTIPLE MICROPHONES

(75) Inventors: Kaustubh Kale, Tamarac, FL (US); Yong Wang, Coram, NY (US)

(73) Assignee: Motorola Solutions, Inc., Schaumburg, IL (US)

( * ) Notice: Subject to any disclaimer, the term of this patent is extended or adjusted under 35 U.S.C. 154(b) by 288 days.

(21) Appl. No.: 12/844,954

(22) Filed: Jul. 28, 2010

(65) Prior Publication Data

US 2012/0027219 A1 Feb. 2, 2012

(51) Int. Cl.
*G10L 19/06* (2013.01)

(52) U.S. Cl.
USPC ..... 704/209

(58) Field of Classification Search
USPC ..... 704/209
See application file for complete search history.

(56) References Cited

U.S. PATENT DOCUMENTS

| | | | | |
|---|---|---|---|---|
| 7,302,062 | B2 | 11/2007 | Christoph | |
| 7,359,504 | B1 * | 4/2008 | Reuss et al. | 379/406.02 |
| 7,957,542 | B2 | 6/2011 | Sarrukh et al. | |
| 2003/0228023 | A1 * | 12/2003 | Burnett et al. | 381/92 |
| 2005/0209657 | A1 * | 9/2005 | Chung et al. | 607/57 |
| 2006/0072767 | A1 * | 4/2006 | Zhang et al. | 381/71.6 |
| 2010/0002886 | A1 * | 1/2010 | Doclo et al. | 381/23.1 |
| 2010/0014690 | A1 * | 1/2010 | Wolff et al. | 381/92 |
| 2011/0026730 | A1 * | 2/2011 | Li et al. | 381/92 |

FOREIGN PATENT DOCUMENTS

| | | | |
|---|---|---|---|
| JP | 2007535853 | A | 12/2007 |
| JP | 2001100800 | A | 4/2011 |
| KR | 20080087939 | A | 10/2008 |

OTHER PUBLICATIONS

International Search Report and Written Opinion for counterpart International Patent Application No. PCT/US2011/043115 mailed on Jan. 5, 2012.

* cited by examiner

*Primary Examiner* — Jakieda Jackson

(57) ABSTRACT

A noise cancellation device includes a plurality of first computation modules, a formant detection module, a direction of arrival module and a beamformer. The plurality of first computation modules receives raw audio data and generates a respective transformed signal as a function of formants. A first transformed signal relates to speech data and a second transformed signal relates to noise data. The formant detection module receives the first transformed signal and generates a frequency range data signal. The direction of arrival module receives the first and second transformed signals, determines a cross-correlation between the first and second transformed signals, and generates a spatial orientation data signal. The beamformer receives the first and second transformed signals, the frequency range data signal, and the spatial orientation data signal and generates modification data at selected formant ranges to eliminate a maximum amount of the noise data.

13 Claims, 7 Drawing Sheets

FORMANT AIDED NOISE CANCELLATION USING MULTIPLE MICROPHONES

BACKGROUND

An electronic device may include an audio input device such as a microphone to receive audio inputs from a user. The microphone is configured to receive any sound and convert the raw audio data into an audio signal for transmission. However, during the course of the microphone receiving the sound, ambient noise is also captured and incorporated into the audio signal.

Conventional technologies have created ways of reducing the ambient noise captured by microphones. For example, a single microphone noise suppressor attempts to capture ambient noise during silence periods and use this estimate to cancel noise. In another example, sophisticated algorithms attempt to reduce the noise floor during speech or are able to reduce non-stationary noise as it moves around. In multiple microphone noise cancellation systems, a beam is directed in space toward the desired talker and attempts to cancel maximum noise from all other directions. However, in all conventional approaches, the attempt to capture clean speech relates to spatial distribution.

SUMMARY OF THE INVENTION

The exemplary embodiments describe a noise cancellation device comprising a plurality of first computation modules, a formant detection module, a direction of arrival module and a beamformer. The plurality of first computation modules receives raw audio data and generates a respective transformed signal as a function of formants. A first transformed signal relates to speech data and a second transformed signal relates to noise data. The formant detection module receives the first transformed signal and generates a frequency range data signal. The direction of arrival module receives the first and second transformed signals, determines a cross-correlation between the first and second transformed signals, and generates a spatial orientation data signal. The beamformer receives the first and second transformed signals, the frequency range data signal, and the spatial orientation data signal and generates modification data at selected formant ranges to eliminate a maximum amount of the noise data.

DETAILED DESCRIPTION

Figure 1A:
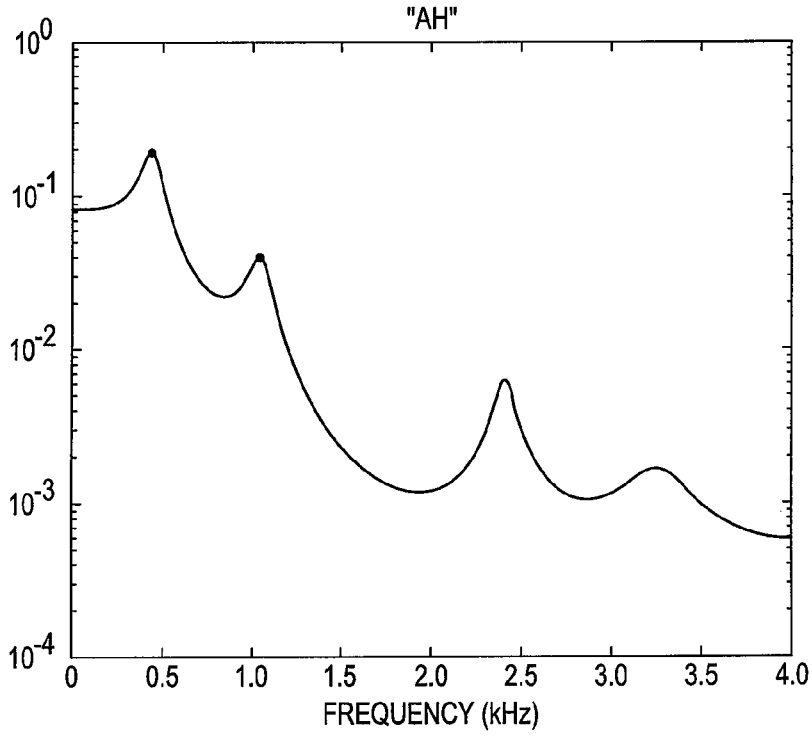
FIG. 1*a* shows a first formant for a first sound.

The exemplary embodiments may be further understood with reference to the following description and the appended drawings, wherein like elements are referred to with the same reference numerals. The exemplary embodiments describe a device and method for noise cancellation using multiple microphones that is formant aided. Specifically, psychoacoustics is considered in reducing noise speech captured through a microphone. The microphones, the noise cancellation, the formants, the psychoacoustics, and a related method will be discussed in further detail below.

Figure 1B:
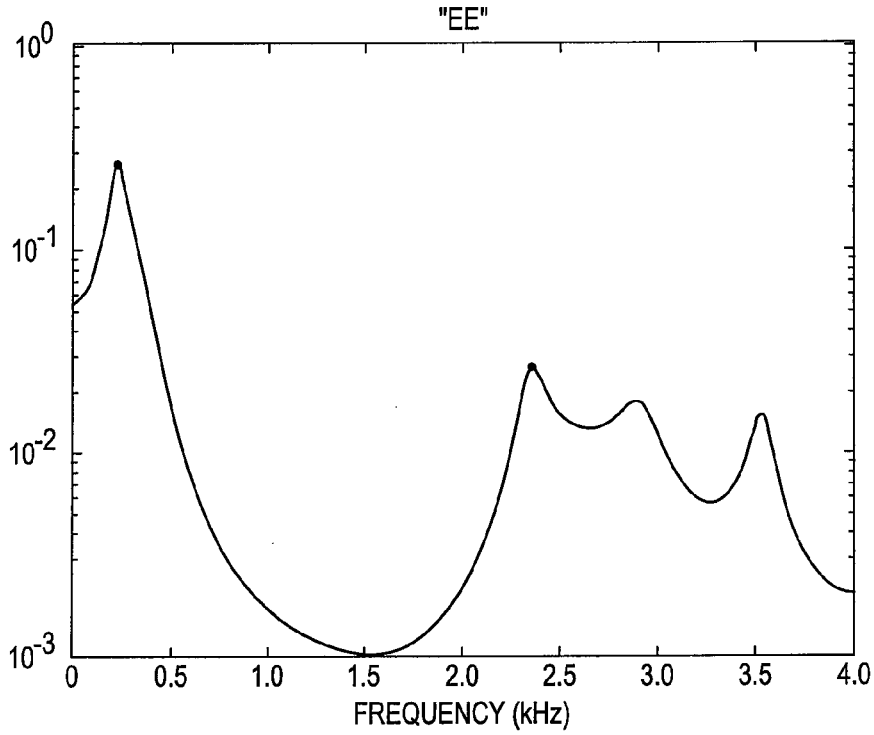
FIG. 1*b* shows a second formant for a second sound.

Those skilled in the art will understand that knowing the psychoacoustics of speech, the energy for a speech signal may be given by formants. FIG. 1*a* shows a first formant for a first sound. Specifically, FIG. 1*a* shows the formant for a typical "AH" sound. As shown, the energy distribution fluctuates throughout the sound. FIG. 1*b* shows a second formant for a second sound. Specifically, FIG. 1*b* shows the formant for a typical "EE" sound. As shown, the energy distribution also fluctuates throughout the sound.

Furthermore, in view of the formants shown in FIGS. 1*a* and 1*b*, the energy distribution changes drastically during conversational speech. For example, if there were noise with a frequency of 1.5 kHz, the noise is more disruptive to the first formant of FIG. 1*a* (i.e., "AH" sound) because the first formant has sufficient audible energy at 1.5 kHz. In contrast, the second formant of FIG. 1*b* (i.e., "EE" sound) is not affected by the noise at 1.5 kHz because, perceptively, no sound is heard in the 1.5 kHz range. Consequently, with noise energy at 1.5 kHz, the "EE" sound is heard with almost no noise affect but the "AH" sound is more difficult to understand. This principle of noise energy at varying frequencies is incorporated in the formant based noise cancellation according to the exemplary embodiments.

Figure 2A:
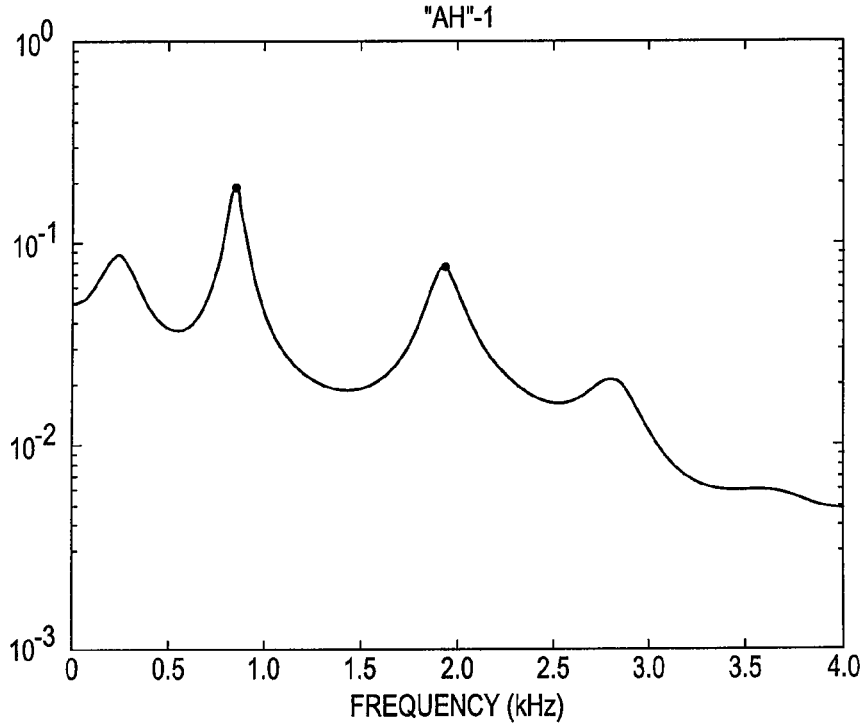
FIG. 2*a* shows a third formant for a third sound.
Figure 2B:
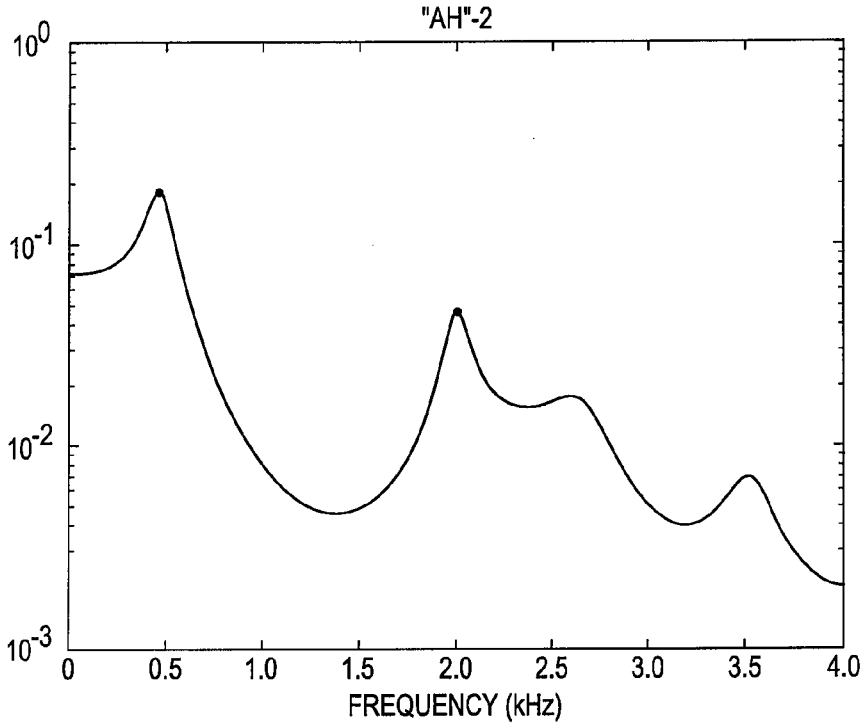
FIG. 2*b* shows a fourth formant for the third sound.

Those skilled in the art will also understand that formant energies may differ from one speaker to another. FIG. 2*a* shows a third formant for a third sound (i.e., "A" sound). FIG. 2*b* shows a fourth formant also for the third sound. It should be noted that FIGS. 2*a* and 2*b* relating to different speakers is only exemplary. The formants of FIGS. 2*a* and 2*b* may also represent an energy distribution from a different speaker for the same sound.

In view of the formants shown in FIGS. 2*a* and 2*b*, the energy distribution differs from one speaker to another speaker although a common sound is being uttered. Again, using a noise with frequency of 1.5 kHz, the noise is more disruptive for the speaker in FIG. 2*a* while not as disruptive for the speaker in FIG. 2*b*. Consequently, with noise energy at 1.5 kHz, the first sound coming from the first speaker is more difficult to understand while the first sound coming from the second speaker is more easily understood. This principle of noise energy at varying frequencies is also incorporated in the formant based noise cancellation according to the exemplary embodiments.

Figure 3:
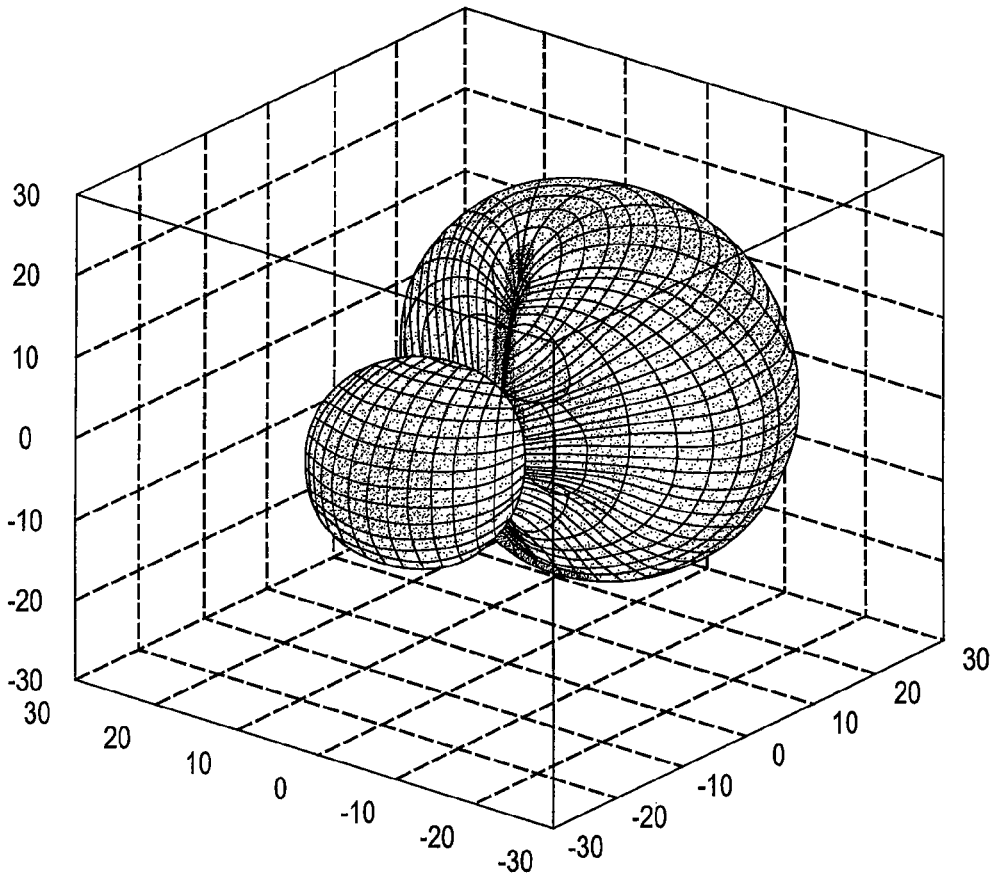
FIG. 3 shows a beam pattern for a microphone.
Figure 4:
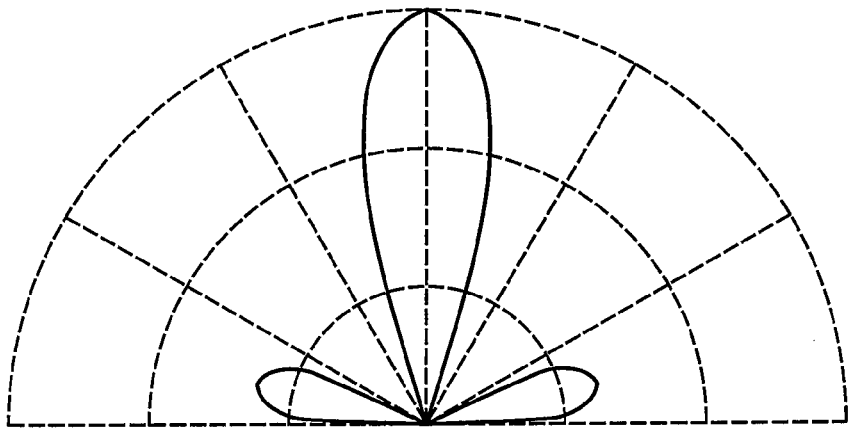
FIG. 4 shows a top view of a beam pattern for a multi-microphone noise cancellation system.

With conventional single or double microphone noise cancellation systems, speech is attempted to be captured as noise free as possible from a single direction by achieving predetermined spatial patterns. With multiple microphone noise cancellation systems, multiple directions may be used to capture the speech. FIG. 3 shows a beam pattern for a microphone. As illustrated in FIG. 3, the source of the speech may be directly in front of the microphone at 90 degrees. FIG. 4 shows a top view of a beam pattern for a multi-microphone noise cancellation system.

Despite spatial orientations of beams of microphones being capable of at least partially reducing noise, it does not account for the psychoacoustics fact that the spatial intensity direction and frequency intensity direction for noise is not always connected. For example, a first noise located at 45 degrees in front of a microphone may be the loudest but may have a maximum intensity at 1.5 kHz. A second noise located at 135 degrees in front of a user might have a lower maximum intensity but may have more intensity than the first noise at a different frequency such as 700 Hz. However, a conventional beamformer will cancel the first noise and not the second noise. Thus, the first noise at 1.5 kHz that does not cause much degradation gets cancelled whereas the noise at 700 Hz that can cause degradation is not cancelled, resulting in a bad audio output signal. Therefore, canceling noise as a function of formant shaping and prioritizing cancellation of noise at frequencies that are more sensitive over noise at frequencies that are less sensitive to noise is desired, thereby leading to significantly improved audio performance. The exemplary embodiments further incorporate this aspect for the formant aided noise cancellation.

Figure 5:
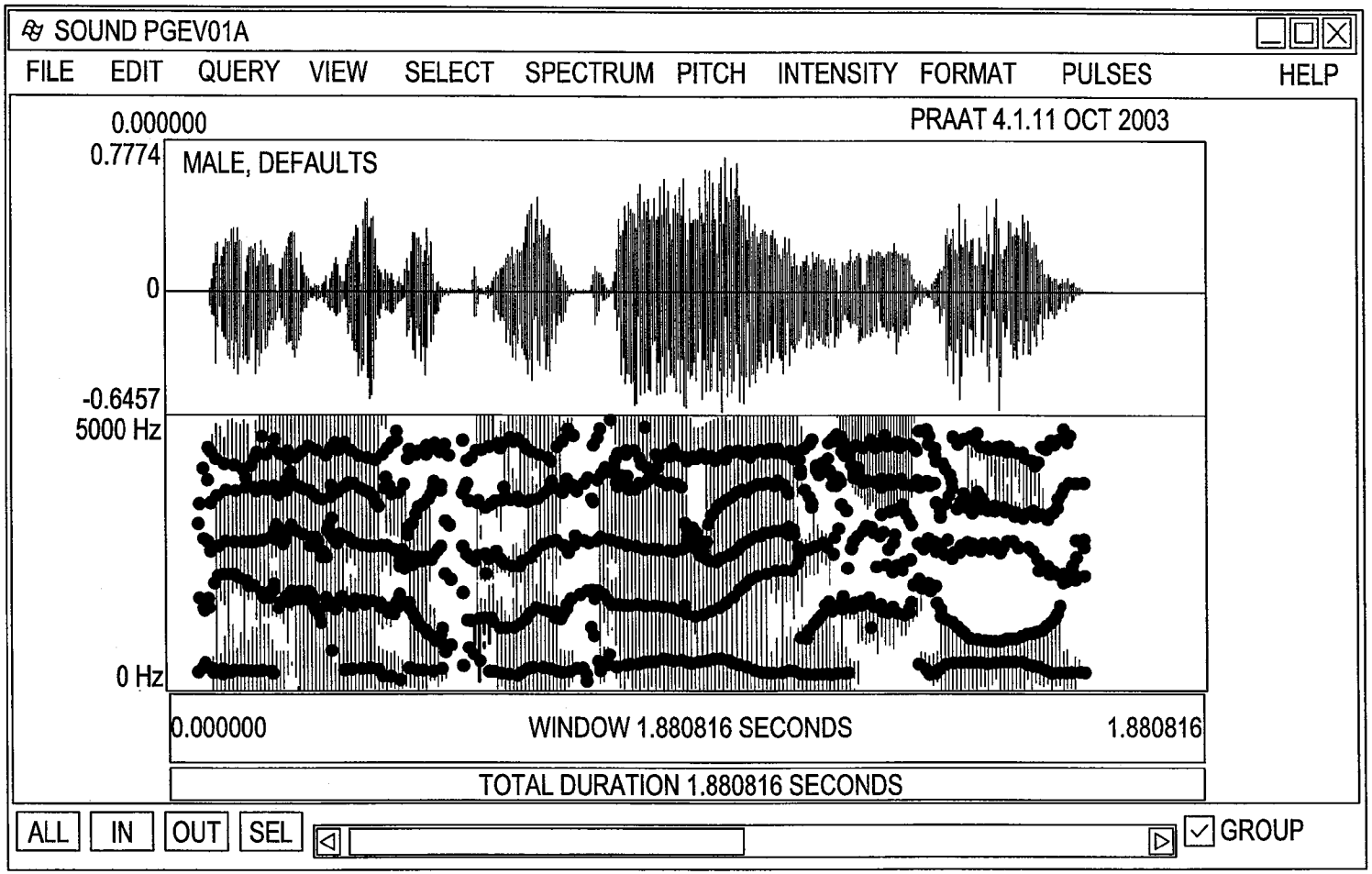
FIG. 5 shows a formant energy distribution of speech for a duration of time.

FIG. 5 shows a formant energy distribution of speech for a duration of time. The distribution illustrates the time domain speech signal of the speaker on the top graph with the corresponding frequency domain signal with formants highlighted on the bottom graph. If noise along the blotted lines 500 are cancelled, the audio quality of speech becomes superior over conventional noise cancellation methods that do not use psychoacoustics knowledge and merely attempts to cancel noise spatially.

The exemplary embodiments estimates formant position and/or maximum speech energy regions in real time using formant tracking algorithms such as Linear Predictive Coding (LPC), Hidden Markov Model (HMM), etc. The formant frequency range data generated is used at a beamforming algorithm that uses the dual microphone input to cancel noise in these frequency ranges.

Figure 6:
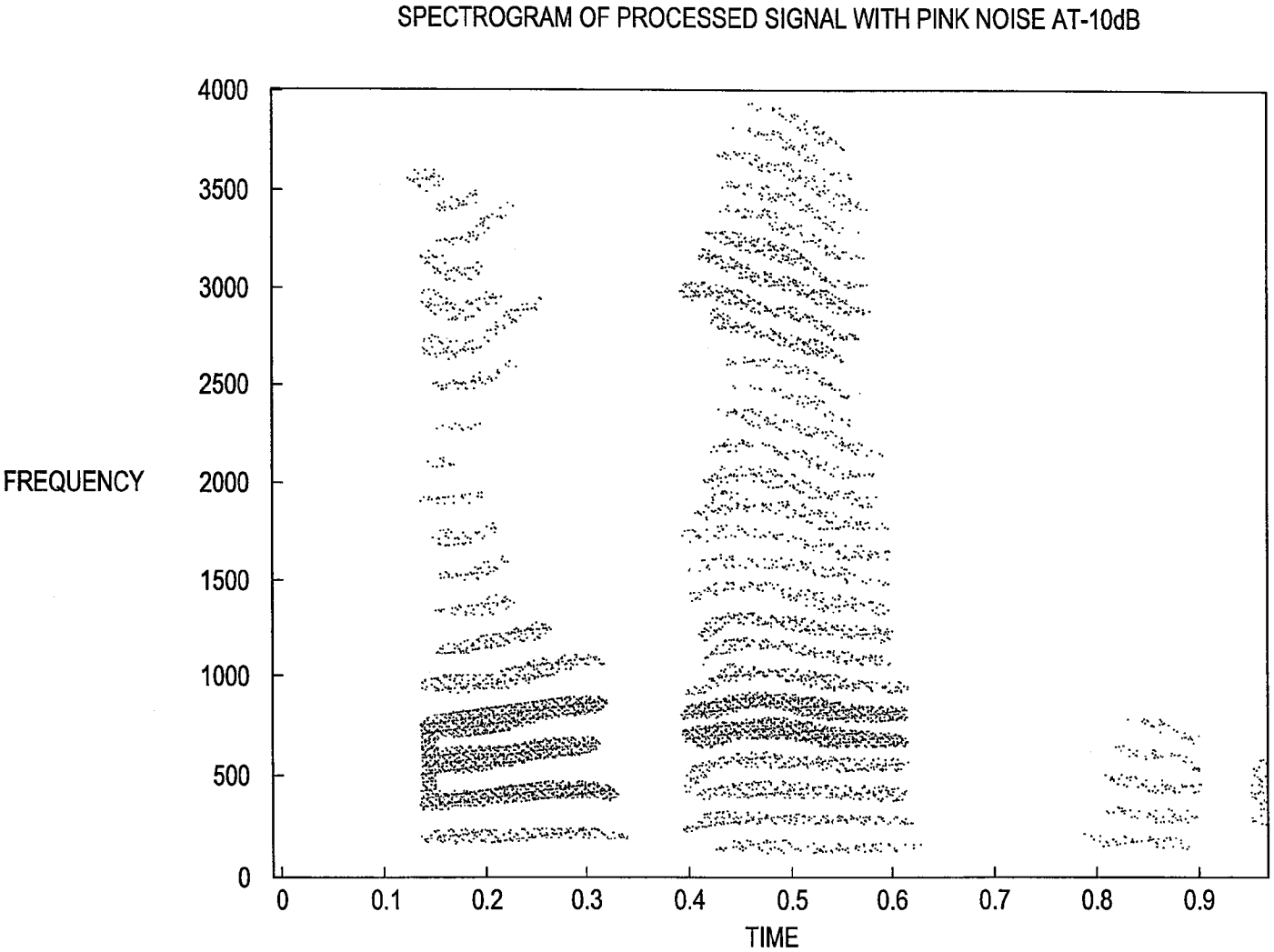
FIG. 6 shows a spectrogram of speech.

FIG. 6 shows a spectrogram of speech for an interfering talker and pink noise coming from a single location in space. As illustrated, the intensity is different at different frequencies and changes with time. For example, between 0.2-0.3 seconds, the maximum intensity is around 500 Hz while between 0.4-0.5 seconds, the intensity is around 500 Hz as well as 2000 Hz and 3000 Hz.

Figure 7:
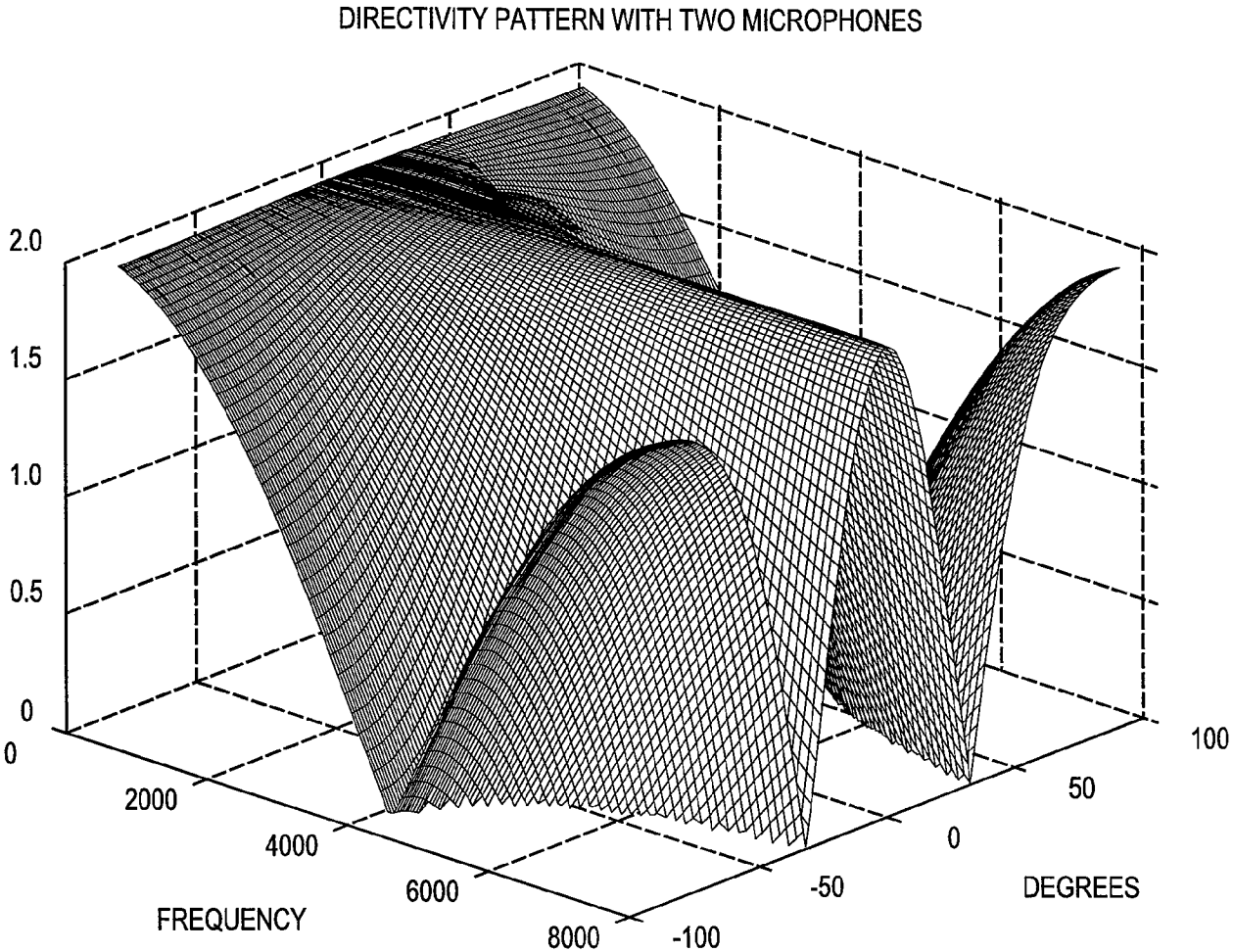
FIG. 7 shows beam patterns with two microphones at a set distance.

FIG. 7 shows beam patterns with two microphones at a set distance. Specifically, FIG. 7 illustrates beam patterns of beamformers. The pattern changes with distance between the at least two microphones. Furthermore, for the same direction, the pattern is different at various frequencies. For example, assuming the speaker is at 0 degrees in front of the microphone, speech is captured perfectly. However, if there is a 7000 Hz noise at 75 degrees, the noise will be captured just as loudly as the speech.

Although there are other beamforming techniques that will, for example, attempt to place a null at 75 degrees to cancel the noise source or attempt to place a null at the speaker and use the rest of the signal as a noise estimate, these techniques succumb to the aforementioned problem in which the location is irrelevant when relating to noise capture. In contrast, the exemplary embodiments consider the location of the frequency of the speech's energy.

Figure 8:
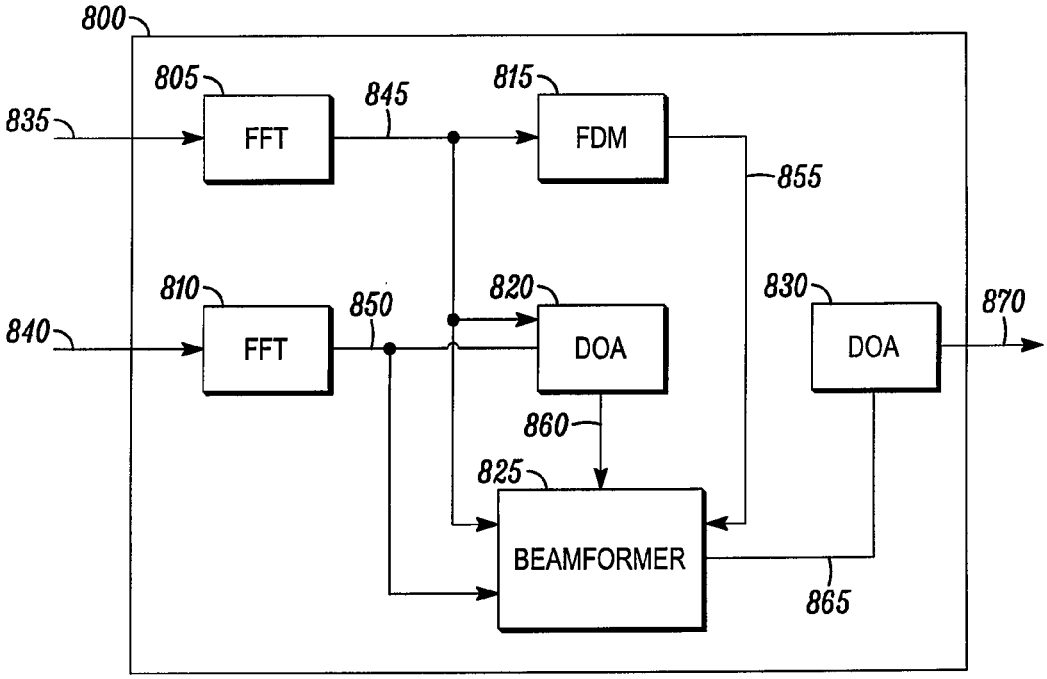
FIG. 8 shows a formant based noise cancellation device according to an exemplary embodiment.

FIG. 8 shows a formant based noise cancellation device 800 according to an exemplary embodiment. The device 800 may be incorporated with any electronic device that includes an audio receiving device such as a microphone. According to the exemplary embodiment of FIG. 8, the electronic device includes a multiple microphone system comprising two microphones. Furthermore, the exemplary embodiment is based on frames of 20 ms of data. Thus, as will be described in further detail below, two frames of 20 ms data will be used while 20 ms of processed output is returned. It should be noted that the use of 20 ms frames of data is only exemplary and the rate is configurable based on the acoustic needs of the platform. It should also be noted that the use of a two microphone system is only exemplary and a system including any number of microphones may be adapted using the exemplary embodiments. The device 800 may include a first Fast Fourier Transform Module (FFT) 805, a second FFT 810, a Formant Detection Module (FDM) 815, a Direction of Arrival module (DOA) 820, a beamformer 825, and an Inverse FFT (IFFT) 830.

The FFT 805 may receive a first microphone speech data 835 while the FFT 810 may receive a second microphone speech data 840. With reference to the exemplary rate of 20 ms, speech samples from the first and second microphones in 20 ms frames are computed by the FFTs 805, 810, respectively. According to the exemplary embodiments, the FFTs 805, 810 may compute a 128, 256, and/or 512 point FFT of a 8 kHz signal, thereby breaking into 64, 128, and/or 256 frequency bins. Again, it should be noted that the computations of the FFTs 805, 810 is only exemplary and the computations may be changed as a function on the resolution desired and the platform capabilities to handle the FFTs' processing. For example, if a 128 point FFT is selected, 64 frequency bins from 0-4000 Hz are generated.

The FFT 805 generates a first speech FFT signal 845 which is received by the FDM 815. The FDM 815 may compute the first, second, and third formant frequency ranges in a particular speech block and generates a formant frequency signal 855 that is received by the beamformer 825.

The FFT 810 also generates a second speech FFT signal 850. Both the first speech FFT signal 845 and the second speech FFT signal 850 are received by the DOA 820. The DOA 820 may compute a cross-correlation between the two signals 845, 850. The resulting two peak signals 845, 850 are assumed to be speech and noise, respectively. If the DOA 820 determines that the second peak of the second signal 850 is not prominent, a null value is provided. This indicates that the noise is wideband and not concentrated around a narrow-band frequency. In general, the output of the DOA 820 are two angles in degrees, the first being for a desired speech signal while the second is for noise.

It should be noted that the assumption for the first signal 845 being for desired speech while the second signal 850 being for noise is also configurable. For example, in a situation where noise is louder than desired speech, the options may be changed so that the first signal 845 represents noise while the second signal 850 represents speech. Consequently, the second signal 850 may be received by the FDM 815 for the respective computations.

According to the exemplary embodiment in which two microphones are present, only two sources are detected. Upon the computations of the FFTs 805, 810, the FDM 815, and the DOA 820, the beamformer 825 receives the first speech FFT signal 845, the second speech FFT signal 850, the formant frequencies signal 855, and a DOA data signal 860.

The beamformer 825 places a null at the noise frequency direction for the formant range of frequencies, thereby eliminating the maximum noise in the range. This process may be performed for all the formant frequency ranges provided. The beamformer 825 may assume that the bandwidth of the formant range is B=[TL, TU], where L is the lower frequency of the formant range and U is the upper frequency of the formant range. It should be noted that the placement of a null is only exemplary. The beamformer 825 may further be used for other purposes. For example, with the signals received by the beamformer 825, modified signal enhancement may also be performed. That is, the beamformer 825 may generate modification data to be used to modify an audio signal to isolate a speech therein or used to enhance a speech of an audio signal.

The DOA 825 may initially select the desired FFT bin frequencies in the bandwidth range. The steering vector is determined by the following:

$$S(\theta)=[1,e^{-jkd\sin\theta},e^{-2jkd\sin\theta},\ldots,e^{-j(N-1)kd\sin\theta}]^T$$

Where k=2πf/c, for M number of sources.

For M narrowband sources, the input vector is determined by the following:

$$X(t)=\left[\sum_{i=1}^{M} m_i(t)S_i\right]e^{j\omega t}$$

With w=[w1, w2, . . . , wN] t as the weight vector, the array output is determined by the following:

$$Y(t)=w^T X(t)$$

Assuming θN is the direction of noise and θS is the direction of sound and the requirement is to place a null at ON and unity at θS, the individual weights for the two microphones is determined by the following:

$$w_1=\frac{e^{-jkd\sin\theta N}}{e^{-jkd\sin\theta N}-e^{-jkd\sin\theta S}}$$

$$w_2=\frac{-1}{e^{-jkd\sin\theta N}-e^{-jkd\sin\theta S}}$$

The DOA 825 multiplies these weights to all the FFT bin frequencies in the formant ranges. Once the weights are multiplied, the DOA 825 generates an output signal 865 including the 128 samples. The IFFT 830 receives the output signal 865 which performs the inverse FFT to generate a speech signal 870 that has noise cancelled for that formant frequency range. Thus, the beamformer 825 receiving the above described signals is capable of canceling noise directly where noise cancellation is required and important.

It should be noted that the exemplary embodiments further account for other scenarios. For example, if a particular speech frame for a formant structure is not detected, the beamformer 825 may use the bandwidth range from 0 to 4000 Hz to allow similar noise suppression when a regular formant structure is missing. Such a scenario may arise, for example, during non-voiced syllables or fricatives. In another example, when the noise is wideband and a distinct direction for noise is not provided (e.g., a null pointer is returned), the beamformer 825 may use a default value of 90 degrees to the user to attempt to cancel the wideband noise affecting the formant structure.

Figure 9:
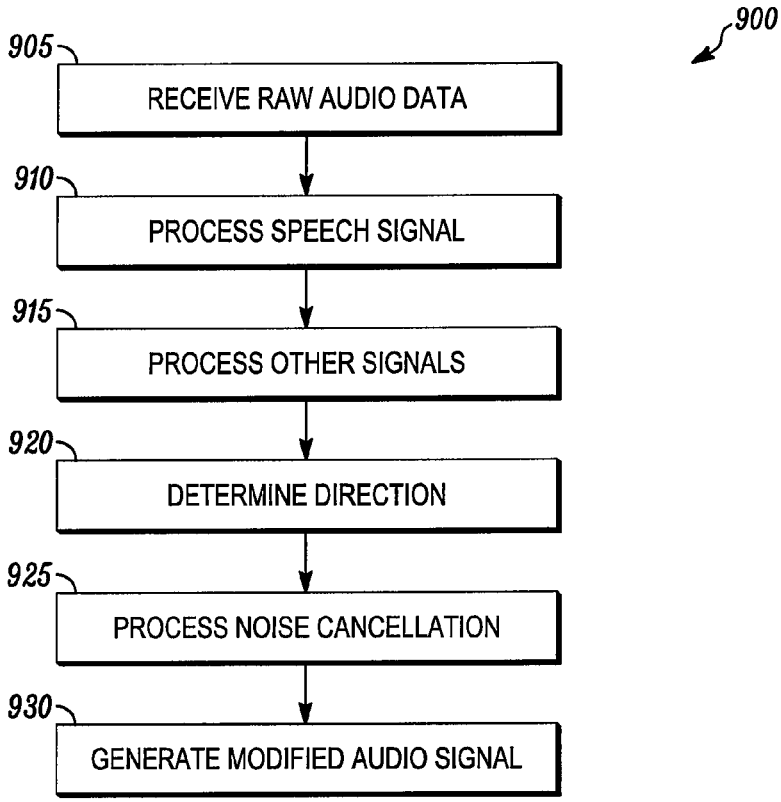
FIG. 9 shows a method for a formant based noise cancellation according to an exemplary embodiment.

FIG. 9 shows a method 900 for a formant based noise cancellation according to an exemplary embodiment. The method 900 may relate to the device 800 and the components thereof including the signals that are passed therein. Therefore, the method 900 will be discussed with reference to the device 800 of FIG. 8. However, those skilled in the art will understand that the exemplary method is not limited to being performed on the exemplary hardware described in FIG. 8. For example, the method 900 may also be applied to multiple microphone systems including more than two microphones.

In step 905, the device 800 receives the raw audio data. As discussed above with reference to the exemplary embodiment of the device 800, the electronic device may include two microphones. Each microphone may generate respective raw audio data 835, 840. In another exemplary embodiment, the raw audio data may be received from more than two microphones. Each microphone may generate a respective raw audio data signal.

In step 910, the speech signal is processed. An initial step may be to determine which of the raw audio data signals comprises the speech signal. As discussed above, a microphone may be designated as the speech receiving microphone. Other factors may be considered such as common formants, formants with known patterns, etc. Upon determining which microphone received the speech signal, a first processing may be the FFT. As discussed above, the speech signal is received at the FFT 805 for the computation to generate the first microphone speech signal 845. Subsequently, a second processing may be performed at the FDM 815. Once the FDM 815 receives the speech signal, the FDM 815 performs the respective computation to generate the formant frequencies signal 855.

In step 915, the other signals are processed. Upon the above described initial step, the remaining signals may be determined to be noise related. In the above exemplary embodiment of the electronic device 800, the remaining signal is the raw audio data 840. However, in other exemplary embodiments including more than two microphones, the remaining signals may include further raw audio data. The remaining raw audio data may be received at the FFT 810 for the computation to generate the second microphone speech signal 845.

In step 920, a direction of arrival for the audio data is determined. For example, the first and second microphone speech signals 845 and 850 are sent to the DOA 820 to perform the respective computation to generate the DOA data signal 860.

In step 925, the noise cancellation is processed. For example, all resulting signals are sent to the beamformer 825. Thus, the beamformer 825 receives the first microphone speech signal 845, the second microphone speech signal 850, the formant frequencies signal 855, and the DOA data signal 860. Using these signals, the beamformer 825 is configured to perform the above described computations according to the exemplary embodiment for a particular frequency. The computations may also be performed for other frequencies. For example, with reference to the above described embodiment, 128 samples are generated by the beamformer 825.

In step 930, a modified audio signal is generated. For example, once the beamformer 825 performs all necessary computations, all samples are sent to the IFFT 830 which performs the respective computation to generate the modified audio signal 870 having only the speech data and canceling the noise data.

The exemplary embodiments provide a different approach for canceling out noise from an audio stream. Specifically, the noise cancellation is performed as a function of formant data and knowledge of psychoacoustics. Using this further information, conventional issues are bypassed in which spatial orientations can only cancel some noise. Spatial orientations also include other issues when noise data is mistaken for speech data and the conversion results in a bad audio stream. The use of formant data and psychoacoustics avoid these issues altogether.

Furthermore, the exemplary embodiments do not rely on techniques like spectral subtraction or Cepstrum synthesis where degradation of speech is possible due to incorrect estimation of speech boundaries or pitch information. The exemplary embodiments instead rely on weight multiplication to the original FFT signal and then continues with IFFT, thereby maintaining a true fidelity of the speech signal to the maximum extent possible.

It will be apparent to those skilled in the art that various modifications may be made in the present invention, without departing from the spirit or scope of the invention. Thus, it is intended that the present invention cover the modifications and variations of this invention provided they come within the scope of the appended claims and their equivalents.

What is claimed is:

1. A noise cancellation device, comprising:

a plurality of modules incorporated within an electronic device, the plurality of modules comprising:

a plurality of Fast Fourier Transform (FFT) modules receiving raw audio data and generating a respective transformed signal as a function of formants, a first transformed signal relating to speech data and a second transformed signal relating to noise data;

a formant detection module receiving the first transformed signal and generating a frequency range data signal;

a direction of arrival module receiving the first and second transformed signals, determining a cross-correlation between the first and second transformed signals, and generating a spatial orientation data signal, the spatial orientation data signal comprising a first angle corresponding to the speech data and a second angle corresponding to the noise data;

a beamformer receiving the first and second transformed signals, the frequency range data signal, and the spatial orientation data signal and generating modification data at selected formant ranges to eliminate a maximum amount of the noise data; and an inverse FFT module receiving the modification data to generate a modified audio data signal that isolates the speech data.

2. The device of claim 1, wherein the modification data further enhances the speech data.

3. The device of claim 1, wherein the transformed signals are separated into a plurality of frequency bins.

4. The device of claim 1, wherein the frequency range data signal includes a plurality of ranges for a predetermined speech block.

5. The device of claim 1, wherein the spatial orientation signal includes at least two angles, a first angle relating to the speech data and a second angle relating to the noise data.

6. The device of claim 1, wherein the modification data is generated at least using weighted data as a function of a direction of the speech and noise signals.

7. The device of claim 6, wherein the weighted data is incorporated to bin frequencies in selected formant ranges.

8. A method, comprising:

receiving raw audio data by a plurality of Fast Fourier Transform (FFT) modules, the Fast Fourier Transform (FFT) modules generating a respective transformed signal as a function of formants, a first transformed signal relating to speech data and a second transformed signal relating to noise data;

generating a frequency range data signal as a function of the first transformed signal;

generating a spatial orientation signal as a function of a cross-correlation between the first and second transformed signals, the spatial orientation data signal comprising a first angle corresponding to the speech data and a second angle corresponding to the noise data;

generating modification data at selected formant ranges to eliminate a maximum amount of the noise data as a function of the first and second transformed signals, the frequency range data signal, and the spatial orientation data signal; and generating a modified audio data signal by an inverse FFT module that isolates the speech data as a function of the modification data.

9. The method of claim 8, wherein the modification data further enhances the speech data.

10. The method of claim 8, wherein the transformed signals are separated into a plurality of frequency bins.

11. The method of claim 8, wherein the frequency range data signal includes a plurality of ranges for a predetermined speech block.

12. The method of claim 8, wherein the spatial orientation signal includes at least two angles, a first angle relating to the speech data and a second angle relating to the noise data.

13. The method of claim 8, wherein the modification data is generated at least using weighted data as a function of a direction of the speech and noise signals.

* * * * *